US012504025B1

(12) United States Patent
Khatri et al.

(10) Patent No.: US 12,504,025 B1
(45) Date of Patent: Dec. 23, 2025

(54) INTERSTAGE CAPACITY CONTROL VALVE WITH SEPARATE DRIVE AND STABILIZATION LINKAGES

(71) Applicant: Trane International Inc., Davidson, NC (US)

(72) Inventors: Ayush Shrikant Khatri, Bengaluru (IN); Robert S. Bakkestuen, West Salem, NC (US); Prathap Kumar Ramamoorthy, Holmen, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 18/901,834

(22) Filed: Sep. 30, 2024

(51) Int. Cl.

| | |
|---|---|
| ***F04D 29/46*** | (2006.01) |
| ***F04D 17/12*** | (2006.01) |
| ***F04D 27/02*** | (2006.01) |
| ***F25B 49/02*** | (2006.01) |

(52) U.S. Cl.
CPC ..... *F04D 29/464* (2013.01); *F04D 17/122* (2013.01); *F04D 27/0246* (2013.01); *F25B 49/022* (2013.01); *F25B 2600/2515* (2013.01)

(58) Field of Classification Search
CPC ..... F04D 29/464
See application file for complete search history.

(56) References Cited

U.S. PATENT DOCUMENTS

| | | | |
|---|---|---|---|
| 11,391,289 | B2 | 7/2022 | James et al. |
| 11,536,277 | B2 | 12/2022 | Harrison et al. |
| 11,661,949 | B2 | 5/2023 | James et al. |
| 11,859,621 | B2 | 1/2024 | Harrison et al. |
| 2014/0328667 | A1 | 11/2014 | Sommer et al. |

FOREIGN PATENT DOCUMENTS

| | | | |
|---|---|---|---|
| CN | 116066389 | A | 5/2023 |
| EP | 4177476 | A1 | 5/2023 |

*Primary Examiner* — Brian O Peters
(74) *Attorney, Agent, or Firm* — HSML P.C.

(57) ABSTRACT

Stabilization and drive linkages of a compressor capacity control valve are separated, for example physically and/or entirely, such that the respective linkages use separate and discrete attachment projections provided on the drive and throttle rings of the capacity control valve. The use of discrete attachment projections places lower stress on each attachment projection compared to linkages including paired stabilization and drive linkages sharing some attachment projections. The stabilization linkages can connect to an interstage casing. The linkage assemblies allow the throttle ring to be driven in an axial direction so as to open or close the compressor capacity control valve.

15 Claims, 10 Drawing Sheets

INTERSTAGE CAPACITY CONTROL VALVE WITH SEPARATE DRIVE AND STABILIZATION LINKAGES

FIELD

This disclosure is directed to an interstage capacity control valve for a centrifugal compressor, particularly one providing flow regulation or distribution and linkages among components thereof.

BACKGROUND

Multi-stage compressors can use single-row or multiple-row, fixed or rotatable return vanes to direct and/or control interstage flow, when operated at full and partial load conditions. These return vanes can, at partial load conditions lead to low-momentum zones in return channel passages or adverse pressure gradients that alter the intended side stream injection flow rate, which can lead to compressor instability, reduced system efficiency, and result in narrower operating ranges.

SUMMARY

This disclosure is directed to an interstage capacity control valve for a centrifugal compressor, particularly one providing flow regulation or distribution and linkages among components thereof.

By using separate and discrete attachments for linkages connected to the respective drive and throttle rings at different locations and not using common projections for attaching both linkages, the stress put on the projections can be reduced. Additionally, assembly can be simplified. Parts costs can also be lower due to the reduced stress placed on attachment projections for the respective linkages and durability can be increased by reducing the tension in the linkage assemblies. The torque on the drive ring required to move the throttle ring can be reduced, making operation of the capacity control valve smoother.

In an embodiment, an assembly for a capacity control valve includes a drive ring and a throttle ring. The assembly further includes a plurality of drive linkages, each drive linkage including a first attachment projection on the drive ring, a second attachment projection on the throttle ring, and a linkage arm joined to each of the first attachment projection and the second attachment projection. The throttle ring includes a plurality of stabilization linkage attachment projections, separate from the second attachment projections of the plurality of drive linkages; and a plurality of stabilization linkage arms, each of the plurality of stabilization linkage arms attached to one of the stabilization linkage attachment projections.

In an embodiment, the assembly further includes an interstage casing, wherein each of the plurality of stabilization linkage arms are attached to the interstage casing.

In an embodiment, the first attachment projections of the plurality of drive linkages are evenly distributed along a circumference of the drive ring.

In an embodiment, the second attachment projections of the plurality of drive linkages are evenly distributed along a circumference of the throttle ring. In one embodiment, the plurality of stabilization linkage attachment projections are evenly distributed along a circumference of the throttle ring, offset from the second attachment projections of the plurality of drive linkages.

In an embodiment, a compressor includes a first impeller, a second impeller, and a plurality of guide vanes forming channels located between the first impeller and the second impeller. The channels are configured to direct an interstage flow of the fluid from the first impeller to the second impeller. The compressor further includes a side stream injection port located between the first impeller and the second impeller. The side stream injection port is configured to receive a side stream of the fluid. The compressor also includes a throttle ring configured to move in an axial direction through the side stream injection port between an extended position and a retracted position, where in the extended position, the throttle ring obstructs flow of the side stream of the fluid through the side stream injection port and partially obstructs the interstage flow of the fluid through the channels, and in the retracted position, the throttle ring allows the side stream of the fluid to flow through the side stream injection port. The compressor also includes a drive ring. The throttle ring and the drive ring are connected by a plurality of drive linkages, each drive linkage including a first attachment projection on the drive ring, a second attachment projection on the throttle ring, and a linkage arm joined to each of the first attachment projection and the second attachment projection. The throttle ring further includes a plurality of stabilization linkage attachment projections, separate from the second attachment projections of the plurality of drive linkages. The compressor also includes a plurality of stabilization linkage arms, and each of the plurality of stabilization linkage arms attached to one of the stabilization linkage attachment projections.

In an embodiment, the compressor further includes an interstage casing, wherein each of the plurality of stabilization linkage arms are attached to the interstage casing.

In an embodiment, the first attachment projections of the plurality of drive linkages are evenly distributed along a circumference of the drive ring.

In an embodiment, the second attachment projections of the plurality of drive linkages are evenly distributed along a circumference of the throttle ring. In an embodiment, the plurality of stabilization linkage attachment projections are evenly distributed along a circumference of the throttle ring, offset from the second attachment projections of the plurality of drive linkages.

In an embodiment, the throttle ring includes teeth, and in the extended position, the teeth of the throttle ring are disposed in and obstruct the channels. In an embodiment, the teeth extend in the axial direction and include tips that curve radially inward.

In an embodiment, the compressor further includes an actuator configured to rotate the drive ring such that the throttle ring is driven to travel in the axial direction.

In an embodiment, a method of assembling a compressor includes providing a drive ring and providing a throttle ring. The method further includes attaching a plurality of first attachment projections to the drive ring and attaching a plurality of second attachment projections to the throttle ring. The method also includes attaching each of a plurality of linkage arms to a corresponding one of the plurality of first attachment projections and to a corresponding one of the plurality of second attachment projections, attaching a plurality of stabilization linkage attachment projections to the throttle ring, the plurality of stabilization linkage attachment projections being separate from the second attachment projections of the plurality of drive linkages, and attaching each of a plurality of stabilization linkage arms to a corresponding one of the stabilization linkage attachment projections.

In an embodiment, the method further includes providing an interstage casing and attaching each of the plurality of stabilization linkage arms to the interstage casing.

DRAWINGS

FIGS. 6A-6D each show a compressor according to an embodiment.

DETAILED DESCRIPTION

This disclosure is directed to an interstage capacity control valve for a centrifugal compressor, particularly one providing flow regulation or distribution and linkages among components thereof.

Interstage capacity control valves are discussed in U.S. Pat. Nos. 11,391,289, 11,536,277, 11,661,949, and 11,859,621, which are herein incorporated by reference in their entirety.

Figure 1:
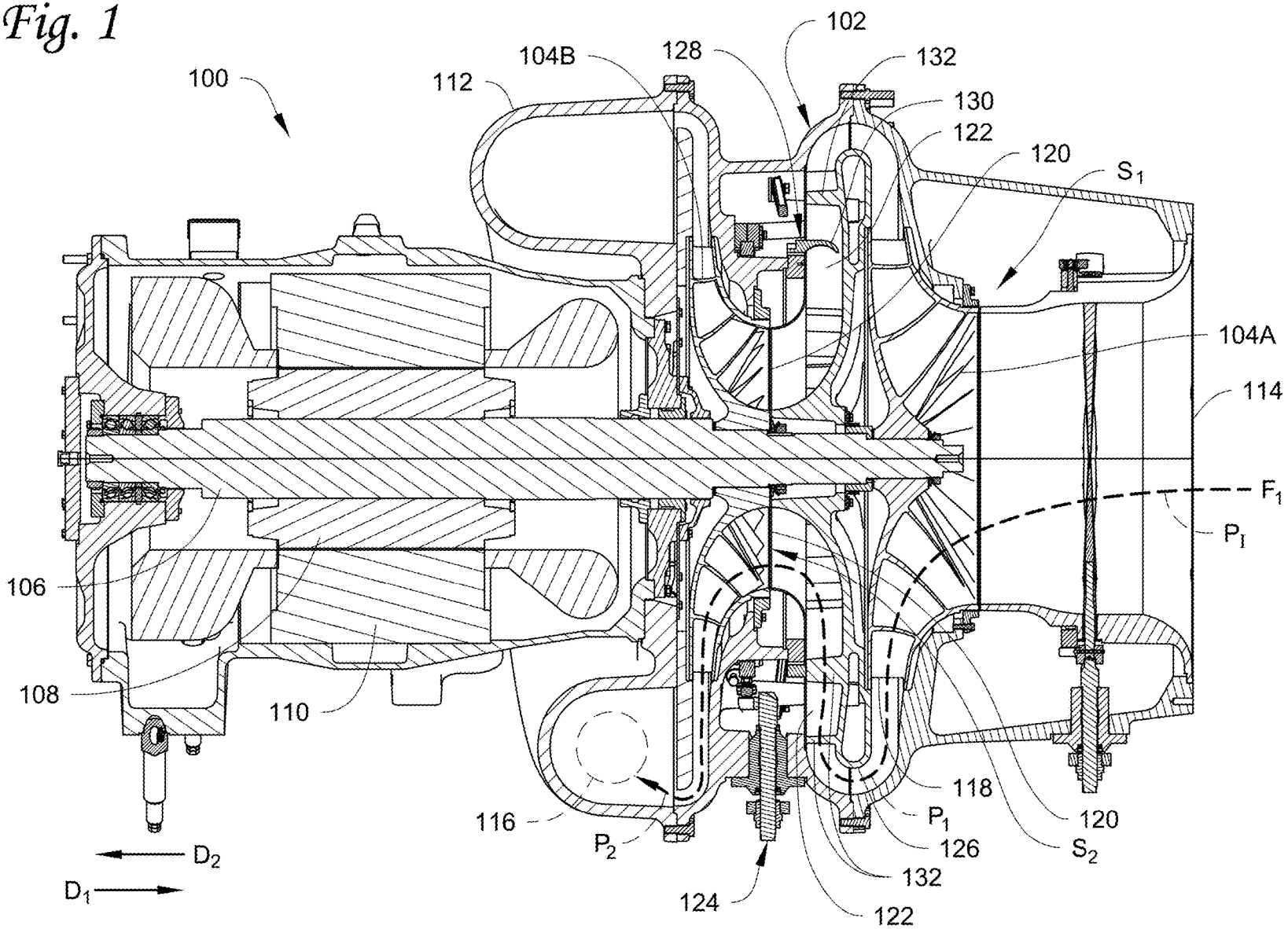
FIG. 1 shows a compressor according to an embodiment.

FIG. 1 shows a compressor according to an embodiment. Compressor 100 is a multi-stage centrifugal compressor. Compressor 100 is configured to compress a suitable working fluid, such as, for example, any suitable refrigerant. Compressor 100 includes first stage $S_1$, the second stage $S_2$, and the interstage throttle 102 that connects the first stage $S_1$ to the second stage $S_2$. The first stage $S_1$ includes the first stage impeller 104A and the second stage $S_2$ includes the second stage impeller 104B which rotate to compress the fluid in their respective stage $S_1$, $S_2$. While the interstage throttle 102 is discussed as being between first stage $S_1$ and second stage $S_2$ in compressor 100, it is understood that interstage throttle 102 can be provided between any two successive stages in a compressor having more than two stages, such as between second and third stages, third and fourth stages, and the like.

The compressor 100 also includes a driveshaft 106, a rotor 108, and a stator 110. The impellers 104A, 104B are each affixed to the driveshaft 106. For example, the first stage impeller 104A is affixed to an end of the driveshaft 106 while the second stage impeller 104B is affixed closer to a middle of the shaft 106. The rotor 108 is attached to the driveshaft 106 and is rotated by the stator 110, which rotates driveshaft 106 and the impellers 104A, 104B. The rotor 108 and stator 110 form an electric motor of the compressor 100. The electric motor (e.g., the stator 110 and the rotor 108) operates according to generally known principles. In another embodiment, the driveshaft 106 may be connected to and rotated by an external electric motor, an internal combustion engine (e.g., a diesel engine or a gasoline engine), or the like. It is appreciated that in such embodiments that the rotor 108 and the stator 110 would not be present within compressor housing 112 of the compressor 100. The driveshaft 106 extends through the first and second stages $S_1$ and $S_2$ as well as the interstage throttle 102 as shown in FIG. 1. It should be appreciated that the terms "axial", "radial", and "circumferential" as used herein are generally with respect to the axis of the compressor 100 (e.g., the axis of the driveshaft 106), unless specified otherwise.

The flow path $F_1$ of working fluid through the compressor 100 is indicated in dashed arrows in FIG. 1. The flow path $F_1$ extends from the suction inlet 114 to the discharge outlet 116 of the compressor 100. The working fluid enters the compressor 100 through the suction inlet 114, is compressed within the first stage $S_1$ by the first impeller 104A, flows through the interstage throttle 102 to the second stage $S_2$, is further compressed in the second stage $S_2$ by the second stage impeller 104B, and is then discharged from the compressor 100 through the discharge outlet 116. The first stage impeller 104A in the first stage $S_1$ is configured to compress the working fluid from an inlet pressure (e.g., pressure $P_1$) to a first pressure $P_1$, and the second stage impeller 104B in the second stage $S_2$ is configured to further compress the working fluid to a second pressure $P_2$ that is greater than the first pressure $P_1$. A side stream of intermediate pressure working fluid can flow (depending on the position of the throttle ring 128) into the flow path $F_1$ between the first stage impeller 104A and the second stage impeller 104A. The pressure of the working fluid flowing into the inlet 120 of the second stage impeller 104A may be different from the first pressure $P_1$ (e.g., can be a pressure between the pressure of the intermediate working fluid and the first pressure $P_1$).

In flow path $F_1$, the interstage throttle 102 is disposed between the first stage impeller 104A of the first stage $S_1$ and the second stage impeller 104B of the second stage $S_2$. The interstage throttle 102 is disposed between the outlet 118 of the first impeller $S_1$ and the inlet 120 of the second impeller 104B. The driveshaft 106 extends through the interstage throttle 102. The interstage throttle 102 fluidly connects the outlet 118 of the first stage impeller 104A to the inlet 120 of the second stage impeller 104B. The interstage throttle 102 directs the working fluid discharged from the first stage $S_1$ (e.g., the compressed working fluid at the first pressure $P_1$) to the second stage impeller 104B of the second stage $S_2$. For example, the interstage throttle 102 directs the compressed working fluid (after being discharged radially outward from the first stage impeller 104A) radially inward to the inlet 120 of the second stage impeller 104B. The interstage throttle 102 also directs the intermediate pressure working fluid to the second stage impeller 104B. For example, the interstage throttle 102 directs the intermediate pressure working fluid into the stream of compressed working fluid flowing from the first stage impeller 104A to the second stage impeller 104B, and then directs the mixture of intermediate pressure working fluid and compressed working fluid radially inward to the inlet 120 for the second stage impeller 104A. The intermediate working fluid can mix with the compressed working fluid from the first stage impeller 104A within channels 122.

The interstage throttle 102 is adjustable to control the flowrate of the compressed working fluid flowing from the first stage $S_1$ to the second stage $S_2$ and the flowrate of the intermediate working fluid into the second stage $S_2$ (e.g., the flowrate of the intermediate working fluid into the compressor 100). The interstage throttle 102 includes the actuator 124 for operating the interstage throttle 102. The actuator 124 is operable/actuates to adjust the flowrate of the compressed working fluid flowing through the interstage throttle 102. For example, a controller (not shown) of the compressor 100 and/or the HVACR controller may be configured to control the capacity of the compressor 100 by controlling the position/actuation of the actuator 124.

The interstage throttle 102 includes the flow guide plate 126 with the guide vanes 132 and the channels 122 formed by the guide vanes 132. The channels 122 spiral radially inward. The working fluid flows through interstage throttle 102 by flowing through the channels 122. The channels 122 direct the working fluid discharged from the first stage $S_1$ radially inward to the inlet 120 of the second stage impeller 104B. The interstage throttle 102 includes the throttle ring 128 configured to be actuated to adjust a size of the channels 122 (e.g., the cross-sectional area of the channels 122).

The throttle ring 128 includes projections 130. The projections 130 may be teeth-like structures (e.g. teeth). The teeth 130 extend towards the flow guide plate 126. The throttle ring 128 is configured to be actuated in the axial direction (e.g., in the positive axial direction $D_1$, in the negative axial direction $D_2$) relative to the channels 122. The axial movement of the throttle ring 128 changes the length of the teeth 130 disposed in the channels 122 to adjust the cross-sectional area of the channels 122. For example, when the throttle ring 128 is actuated towards the channels 122 (e.g., in a positive axial direction $D_1$), the teeth 130 extend further into the channels 122 and reduce the cross-sectional area of the channels 122. As each tooth 130 is disposed further into its respective channel 122, the tooth 130 partially blocks more of the channel 122 and decreases the cross-sectional area of the channel 122 (e.g., decreases the open cross-sectional area in each channel 122). The decreased cross-sectional area of the channels 122 decreases the flowrate of the working fluid through the channels 122 and the interstage throttle 102. When the throttle ring 128 is actuated away from the channels 122 (e.g., in the negative axial direction $D_2$), the teeth 130 extend less into the channels 122 and the cross-sectional area of the channels 122 is increased, which increases the flow of the working fluid through the interstage throttle 102. For example, the throttle ring 128 in an embodiment may have the retracted position in which the teeth 130 are disposed entirely outside of the channels 122.

Figure 2A:
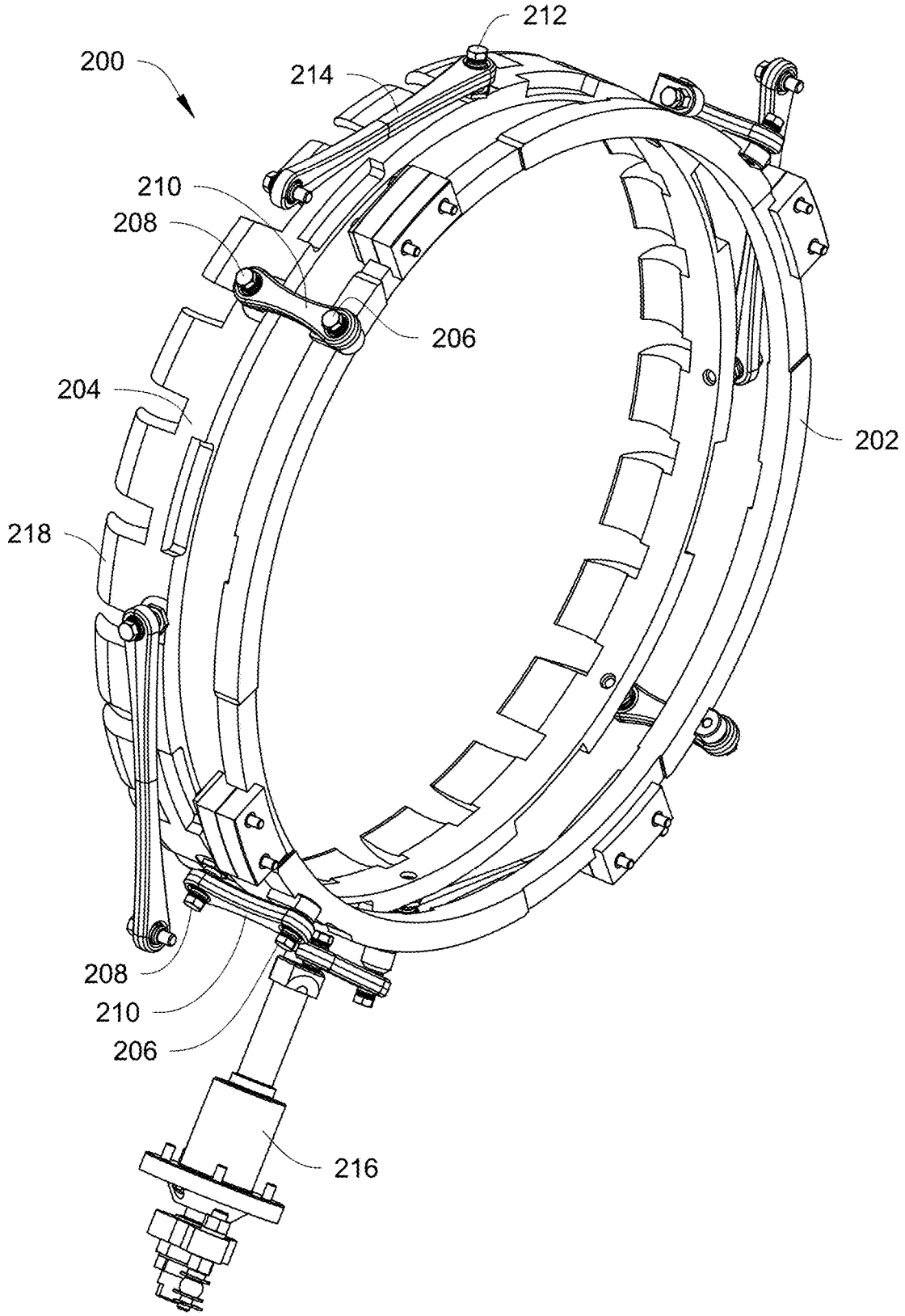
FIG. 2A shows an assembly for a capacity control system according to an embodiment.

FIG. 2A shows an assembly for a capacity control system according to an embodiment. As shown in FIG. 2A, the capacity control system assembly 200 includes drive ring 202 and throttle ring 204. Drive ring 202 includes first attachment projections 206 and throttle ring 204 includes second attachment projections 208. Linkage arms 210 are each connected to one of the first attachment projections 206 and one of the second attachment projections 208. Throttle ring 204 further includes stabilization linkage attachment projections 212. Stabilization linkage arms 214 are each attached to one of the stabilization linkage attachment projections 212.

Capacity control system assembly 200 is configured to control a position of a capacity control system, so as to control interstage flow and/or the introduction of a side stream into said interstage flow between stages of the compressor. Capacity control system assembly 200 can be used to position the throttle ring 204 in a suitable position for controlling the side stream and/or deflecting the interstage stream of working fluid in a compressor such as compressor 100 described above and shown in FIG. 1.

Drive ring 202 is a ring configured to be rotated such that the rotation of drive ring 202 can be provided to in turn drive translational motion of the throttle ring 204. Drive ring 202 can be connected to a rotation interface 216 configured to allow the rotational force to be applied to drive ring 202, for example by way of an actuator and any suitable mechanical connections such as levers, bushings, gears, or the like to provide rotational force to drive ring 202.

Throttle ring 204 is configured to interact with a side stream injection port and an interstage flow in a compressor, so as to affect the interstage flow and/or control a flow through the side stream injection port. Throttle ring 204 can be configured to be movable along an axial direction so as to be extended into or retracted from the side stream injection port so as to control the flow therethrough and/or to deflect the interstage flow. Throttle ring 204 can include projections 218, which in some examples may be configured as teeth-like structures. Teeth 218 extend from an end of said throttle ring 204. The teeth 218 can be configured so as to avoid deswirl vanes positioned in an interstage flow path of the compressor even when throttle ring 204 is extended.

Figure 2B:
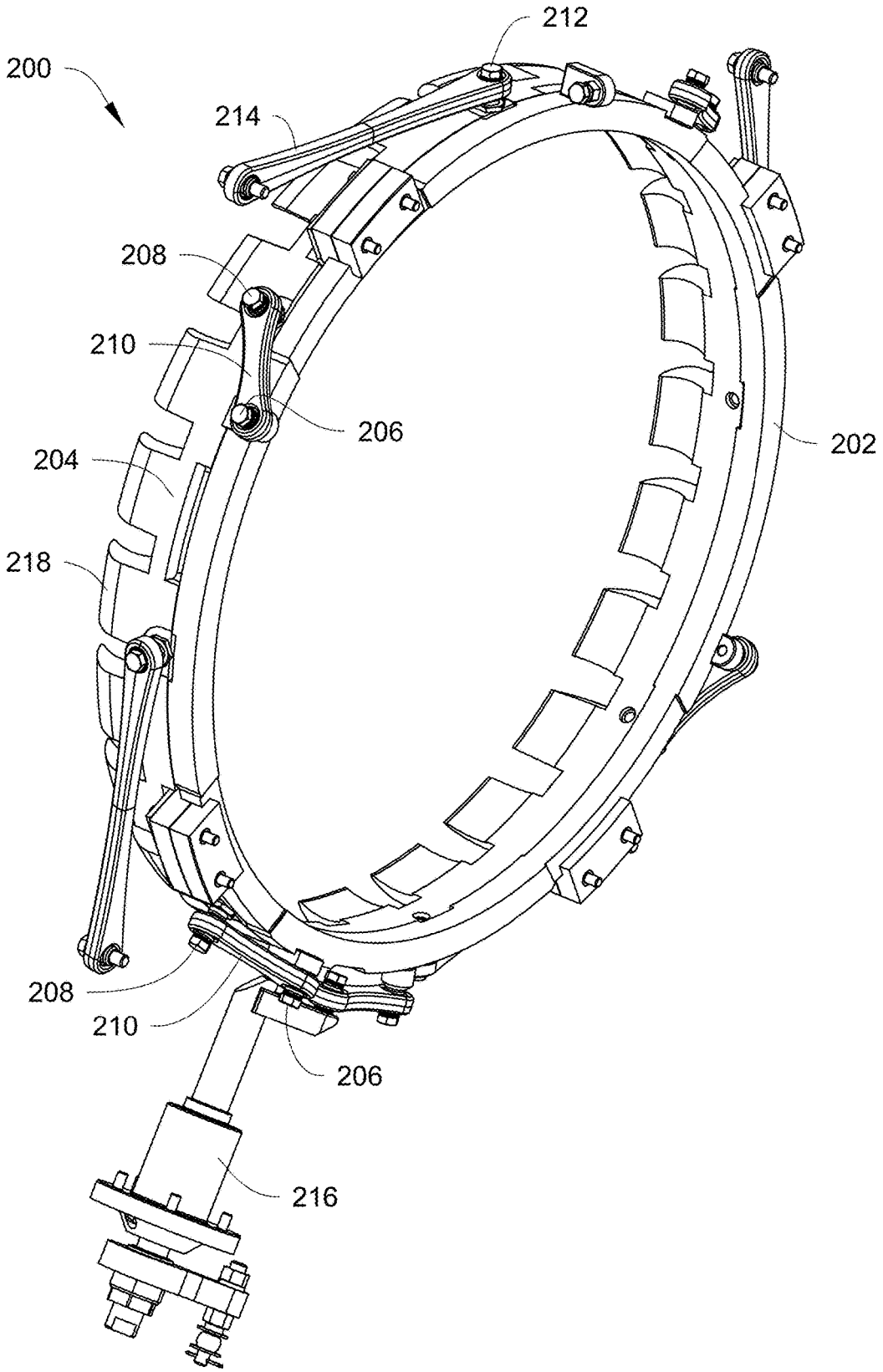
FIG. 2B shows the assembly for the capacity control system of FIG. 2A.

As shown in FIGS. 2A and 2B, the drive ring 202 may have at or about the same circumference as the throttle ring 204, for example depending on manufacturing, design tolerances, and the like. In an embodiment, the circumferences of the drive ring 202 and the throttle ring 204 are less than at or about 10% different. In another embodiment, the circumferences of the drive ring 202 and the throttle ring 204 may be less than at or about 5% different.

First attachment projections 206 are provided on the drive ring 202. Each of first attachment projections 206 is a projection configured to interface with a corresponding one of the linkage arms 210. In an embodiment, the first attachment projections 206 are each configured to only interface with the corresponding one of linkage arms 210. The first attachment projections 206 can be radially distributed around the drive ring 202. In an embodiment, the first attachment projections are evenly radially distributed around the drive ring 202. As used herein, "evenly radially distributed" means that the angles between adjacent attachment projections are the same, for example having angles of at or about 120 degrees between each of three attachment projections, angles of at or about 90 degrees between each of four attachment projections, or the like. In an embodiment, each of first attachment projections 206 only connects drive ring 202 to a single one of the linkage arms 210. In an embodiment, the first attachment projections 206 are attached to the drive ring 202, for example being a bolt attached to the drive ring 202. The attachment of first attachment projections 206 can be through any suitable adhesives, welds, mechanical connections such as threading or other mechanical connections, or the like. In an embodiment, the first attachment projections 206 can be projections formed integrally with the drive ring 202.

Second attachment projections 208 are provided on the throttle ring 204. Each of second attachment projections 208 is a projection configured to interface with a corresponding one of the linkage arms 210. In an embodiment, the second attachment projections 208 are each configured to only interface with the corresponding one of linkage arms 210. In an embodiment, the second attachment projections 208 can interface with linkage arms 210 at an end of the respective linkage arm 210 opposite the end where the respective linkage arm interfaces with one of first attachment projections 206. The second attachment projections 208 can be radially distributed around the throttle ring 204. In an embodiment, the second attachment projections can be evenly radially distributed around the throttle ring 204. In an embodiment, each of second attachment projections 208 only connects throttle ring 204 to a single one of the linkage arms 210. In an embodiment, the second attachment projections 208 are attached to the throttle ring, for example each being a bolt attached to the throttle ring 204. The attachment of second attachment projections 208 can be through any suitable adhesives, welds, mechanical connections such as threading or other mechanical connections, or the like. In an embodiment, the second attachment projections 208 can be projections formed integrally with the throttle ring 204.

Linkage arms 210 are arms each connected to one of the first attachment projections 206 and to one of the second attachment projections 208. The linkage arm 210 can be the only member other than the respective drive ring 202 or throttle ring 204 connected to the corresponding first attachment projection 206 and the corresponding second attachment projection 208. The linkage arms 210 can each have a fixed length selected to transfer rotation of the linkage arm 210 into a translational motion to be transferred to the throttle ring 204.

Stabilization linkage attachment projections 212 are a plurality of discrete projections provided on throttle ring 204. The stabilization linkage attachment projections 212 can be separate and distinct from the second attachment projections 208. For example, the stabilization linkage attachment projections are entirely and/or physically separate and distinct from the second attachment projections 208. The stabilization linkage attachment projections 212 are each configured to interface with a corresponding one of the stabilization linkage arms 214. In an embodiment, each of the stabilization linkage attachment projections 212 is configured to only interface with the corresponding one of the stabilization linkage arms 214. In an embodiment, the stabilization linkage attachment projections 212 are attached to the throttle ring 204, for example each being a bolt attached to the throttle ring 204. The attachment of stabilization linkage attachment projections 212 can be through any suitable adhesives, welds, mechanical connections such as threading or other mechanical connections, or the like. In an embodiment, the stabilization linkage attachment projections 212 can be projections formed integrally with the throttle ring 204.

Stabilization linkage arms 214 are each connected to the throttle ring 204 at one of the respective stabilization linkage attachment projections 212. The stabilization linkage arms 214 can also be attached to fixed points such as fixed points provided on a housing of the compressor including capacity control assembly 200, such that the stabilization linkage arms 214 and the connections thereof constrain rotation and facilitate translational motion of the throttle ring 204 when drive ring 202 is rotated.

FIG. 2B shows the assembly for the capacity control system of FIG. 2A. In FIG. 2B, the drive ring 202 has been rotated, for example by operation of the rotation interface 216, such that the assembly 200 is moved to a retracted position. In particular, rotation of the drive ring 202 moves the first attachment projections 206 relative to the positions of the respective second attachment projections 208 such that the linkage arms 210 rotate and draw the throttle ring 204 towards the drive ring 202, thus placing the capacity control system 200 into the retracted state. The stabilization linkage arms 214 connected to stabilization linkage attachment projections 212 can constrain the rotation of the throttle ring 204 to facilitate the relative movements of the first attachment projections 206 and linkage arms 210 so as to achieve the retraction of the throttle ring 204.

Figure 3:
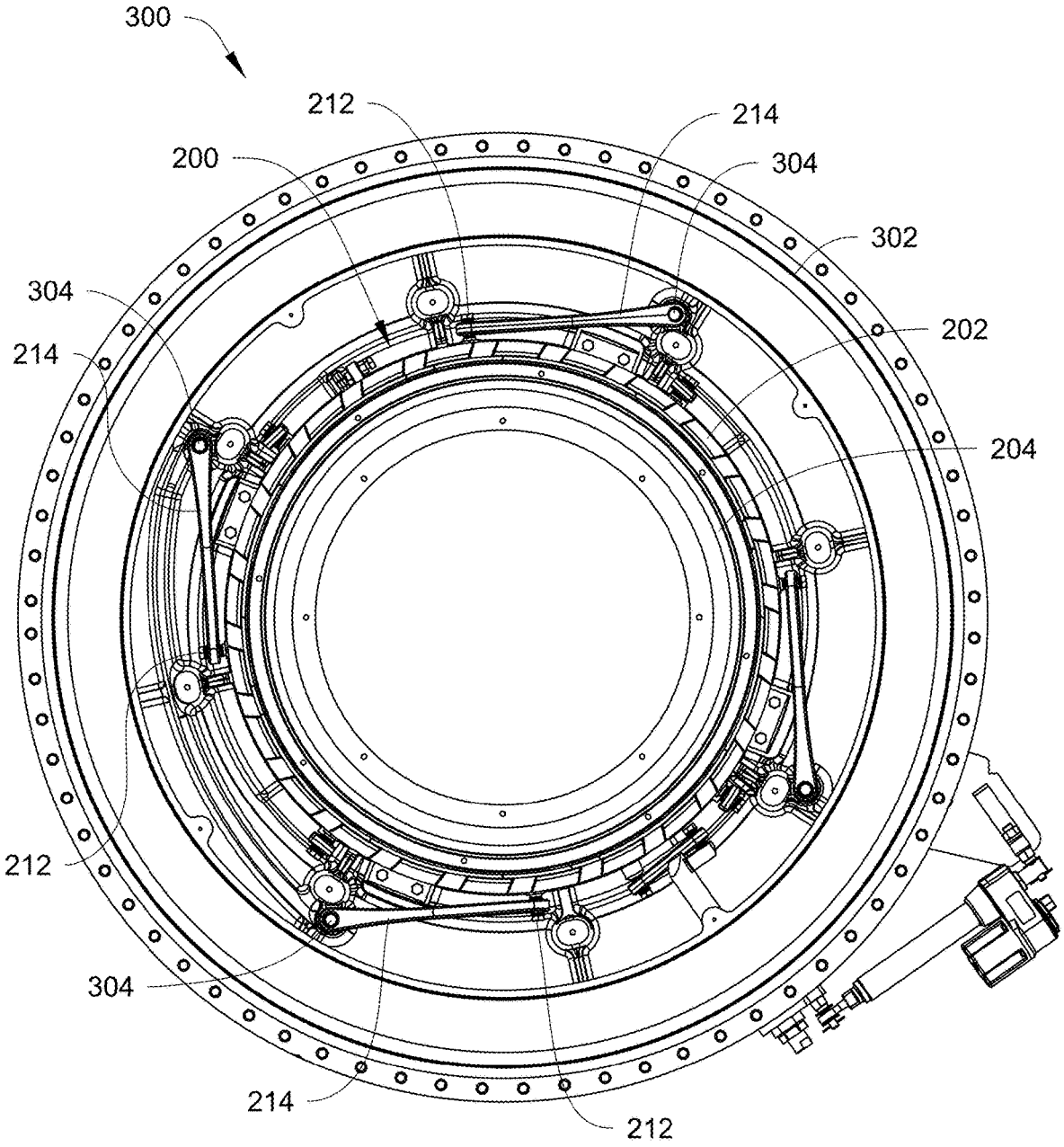
FIG. 3 shows an assembly for a capacity control system installed into a compressor according to an embodiment.

FIG. 3 shows an assembly for a capacity control system installed into a compressor according to an embodiment. Compressor 300 includes capacity control system 200 as described above and shown in FIGS. 2A and 2B, and interstage casing 302. As shown in FIG. 3, the stabilization linkage arms 214 connect to fixed points 304 provided on the interstage casing 302 and to the corresponding stabilization linkage attachment projections 212. By connecting to the fixed points 304 provided on the interstage casing 302, the stabilization linkage arms 214 can constrain rotation of the throttle ring 204 such that the throttle ring 204 can be driven translationally by rotation of the drive ring 202 relative to throttle ring 204 and the movement of the linkage arms 210 about their respective connections at the respective first attachment projection 206 and second attachment projection 208.

Figure 4:
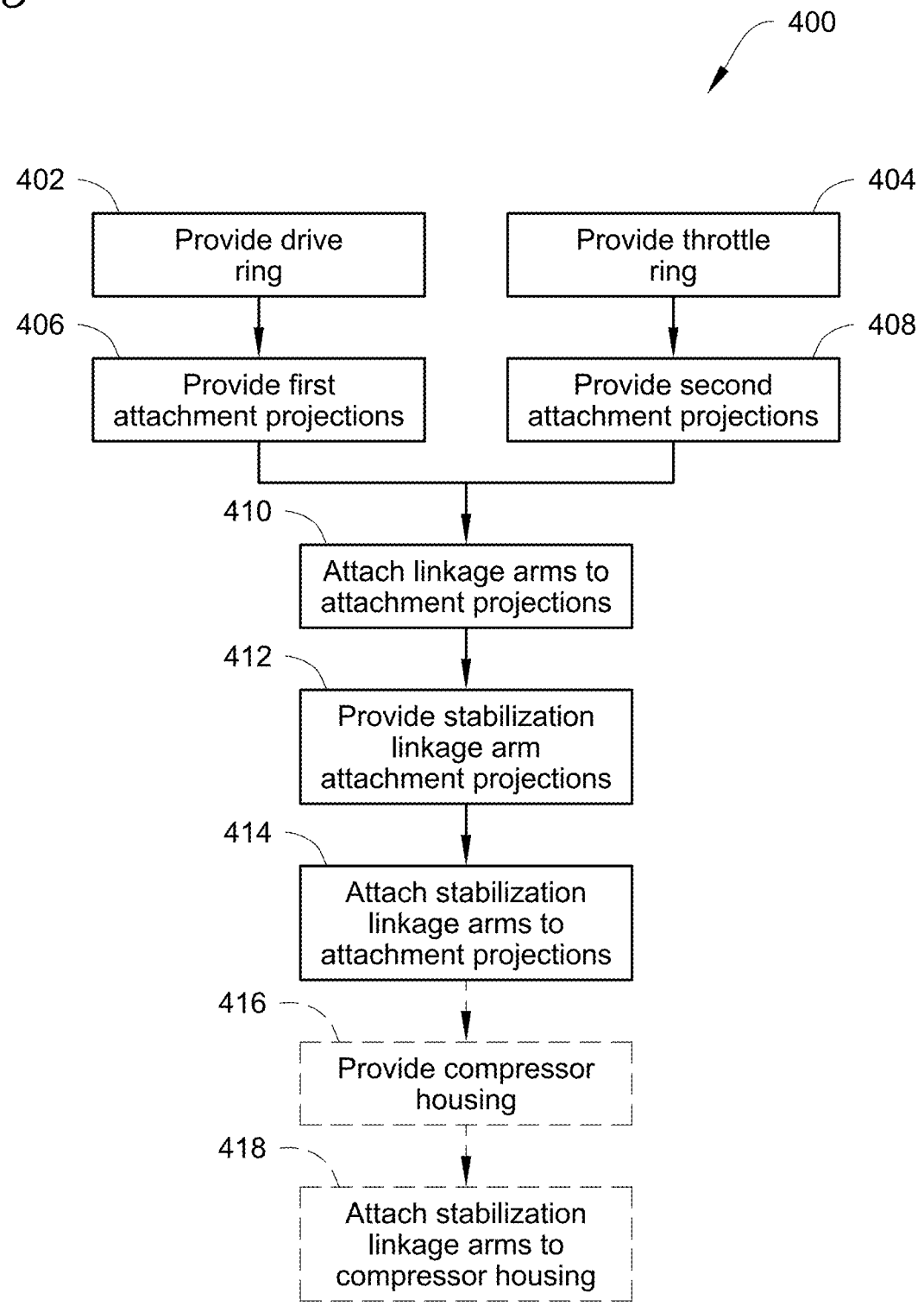
FIG. 4 shows a method of assembling a compressor according to an embodiment.

FIG. 4 shows a method of assembling a compressor according to an embodiment. Method 400 includes providing a drive ring 402, providing a throttle ring 404, providing a plurality of first attachment projections on the drive ring 406, and providing a plurality of second attachment projections on the throttle ring 408. Method 400 further includes attaching each of a plurality of linkage arms to a corresponding one of the plurality of first attachment projections and to a corresponding one of the plurality of second attachment projections 410. Method 400 additionally includes providing a plurality of stabilization linkage attachment projections on the throttle ring 412 and attaching each of a plurality of stabilization linkage arms to a corresponding one of the stabilization linkage attachment projections 414. Optionally, method 400 can further include providing a compressor housing 416, such as for example an interstage casing as shown in FIG. 3, and attaching each of the plurality of stabilization linkage arms to the compressor housing 418.

Method 400 can be steps in the assembly of a compressor and/or assemblies thereof. The compressor assembled according to method 400 can be a compressor having a capacity control system, and an assembly assembled according to method 400 can be a capacity control system or a portion thereof for use in a compressor. The compressor resulting from method 400 or using an assembly assembled according to method 400 can be a multi-stage centrifugal compressor. In an embodiment, method 400 can be used in the assembly of compressor 100 as described above and shown in FIG. 1. In an embodiment, method 400 can be used to assemble the assembly for a capacity control system 200 as described above and shown in FIGS. 2A and 2B and FIG. 3. It is understood that the steps of method 400 can be performed in any suitable order and that some steps may be combined, if possible, for example providing attachment projections at 406 and/or 408 while attaching the linkage arms at 410 or the like.

A drive ring is provided at 402. The drive ring can be, for example, the drive ring 202 as described above and shown in FIGS. 2A and 2B. A throttle ring is provided at 404. The throttle ring can be, for example, the throttle ring 204 as described above and shown in FIGS. 2A and 2B.

Method 400 can include providing plurality of first attachment projections on the drive ring at 406. The first attachment projections can be first attachment projections 206 as described above and shown in FIGS. 2A and 2B. The first attachment projections can be provided on the drive ring at 406 by attaching said first attachment projections to the drive ring, for example by making any suitable connection between the first attachment projections and the drive ring, such as mechanical connections, welds, adhesives, combinations thereof, or the like. Non-limiting examples of mechanical connections can include threading, press-fit, engagement of any suitable engagement features, or the like.

Method 400 can include providing a plurality of second attachment projections to the throttle ring at 408. The second attachment projections can be second attachment projections 208 as described above and shown in FIGS. 2A and 2B. The second attachment projections can be provided on the throttle ring at 408 by attaching said second attachment projections to the drive ring, for example by making any suitable connection between the first attachment projections and the drive ring, such as mechanical connections, welds, adhesives, combinations thereof, or the like. Non-limiting examples of mechanical connections can include threading, press-fit, engagement of any suitable engagement features, or the like.

Each of a plurality of linkage arms are attached to a corresponding one of the plurality of first attachment projections and to a corresponding one of the plurality of second attachment projections 410. The linkage arms can be the linkage arms 210 as described above in FIGS. 2A and 2B. In an embodiment, the attachments at 410 can be performed during the attachment of the corresponding attachment projections at 406 and 408, for example by directing a bolt used as the corresponding attachment projection through a corresponding aperture of the linkage arm. Each of the plurality of linkage arms can be connected to only one of the first attachment projections and only one of the second attachment projections. In an embodiment, each of the attachment projections can be attached only to the corresponding portion of the corresponding linkage arm following the attachments at 410.

A plurality of stabilization linkage attachment projections are provided on the throttle ring at 412. The stabilization linkage attachment projections can be stabilization linkage attachment projections 212 as described above and shown in FIGS. 2A and 2B. The stabilization linkage attachment projections can be physically and/or completely separate and distinct from the second attachment projections provided on the throttle ring at 408. Providing the second attachment projections to the throttle ring at 412 can include attaching the attachment projections to the throttle ring, for example by making any suitable connection between the stabilization linkage attachment projections and the throttle ring, such as mechanical connections, welds, adhesives, combinations thereof, or the like. Non-limiting examples of mechanical connections can include threading, press-fit, engagement of any suitable engagement features, or the like.

Each of a plurality of stabilization linkage arms are attached to a corresponding one of the stabilization linkage attachment projections at 414. The stabilization linkage arms can be second attachment arms 214 as described above and shown in FIGS. 2A and 2B. Each of the stabilization linkage arms can be the only element attached to each respective stabilization linkage arm provided at 412. In an embodiment, the attachments at 414 can be performed during the attachment of the corresponding stabilization linkage attachment projections 412, for example by directing a bolt used as the corresponding stabilization linkage attachment projection through a corresponding aperture of the stabilization linkage arm. The attachments of the stabilization linkage arms formed at 414 can be physically separate and distinct from any of the connections of the linkage arms to the first and second attachment projections.

Optionally, method 400 can further include providing a compressor housing 416, such as, for example, a housing having an interstage casing as shown in FIG. 3. The compressor housing can be, for example, part of compressor housing 112 as discussed above and shown in FIG. 1, or interstage casing 302 as discussed above and shown in FIG. 3. The compressor housing can include features or fixed locations for attachment of the stabilization linkage arms, such as threaded openings for receiving bolts or any suitable mechanical features for interfacing with the stabilization linkage arms.

Each of the plurality of stabilization linkage arms can be attached to the compressor housing at 418. The attachments can be through any suitable connection between the stabilization linkage attachment arms and the compressor housing, such as mechanical connections or the like. Non-limiting examples of mechanical connections can include use of mechanical fasteners such as bolts, engagement of any suitable engagement features, or the like.

Figure 5:
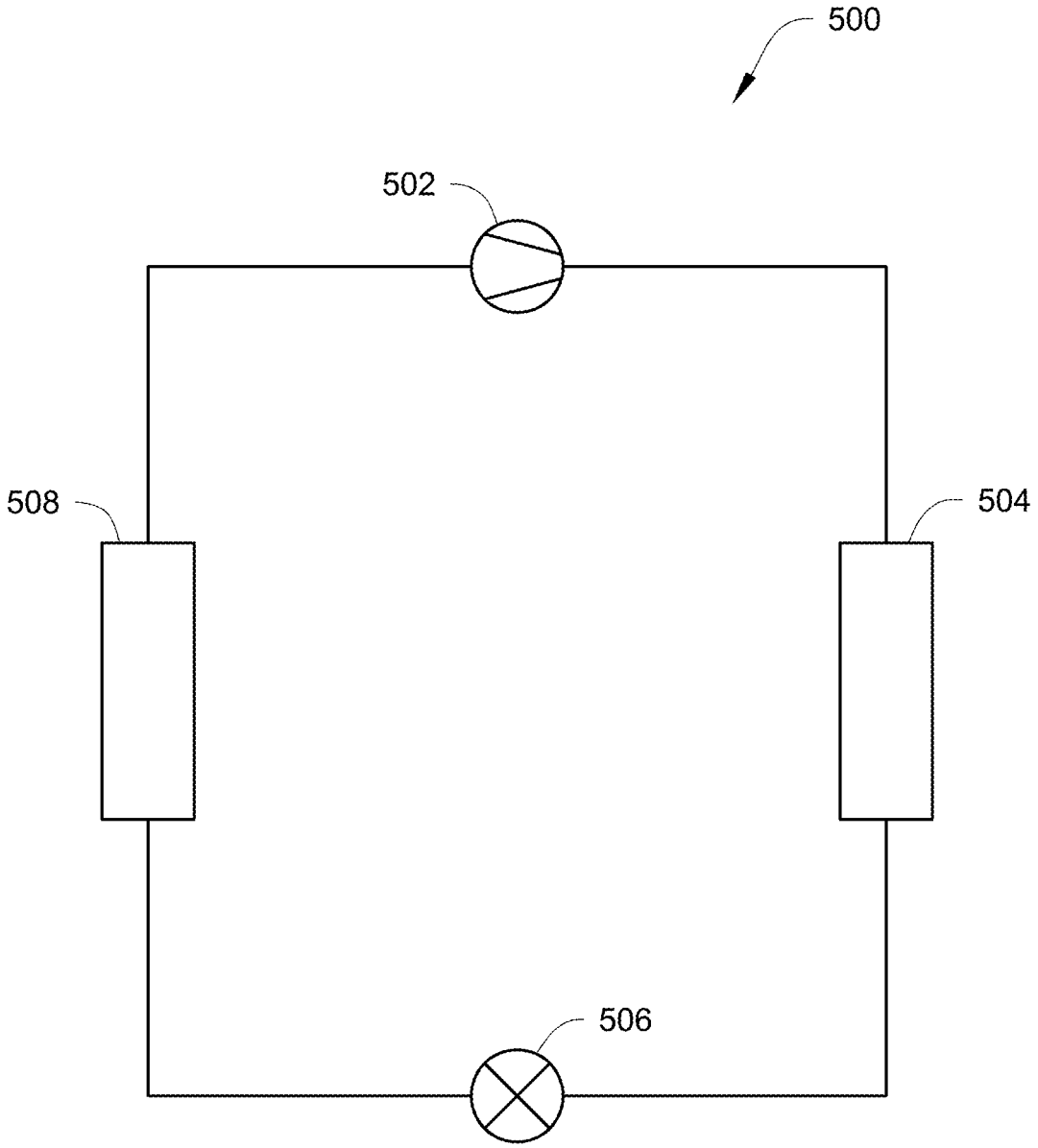
FIG. 5 shows an HVACR system including a compressor according to an embodiment.

FIG. 5 shows an HVACR system including a compressor according to an embodiment. HVACR system 500 includes compressor 502, condenser 504, expander 506, and evaporator 508.

HVACR system 500 is a system configured to provide heating and/or cooling using a compression cycle of a working fluid. The working fluid can be any suitable working fluid, such as a refrigerant or blend thereof. In the embodiment shown in FIG. 5, the HVACR system 500 is configured to provide cooling in a chiller system, however it is understood that HVACR systems including compressors according to embodiments can also be arranged as heat pumps, reversible systems, or any other suitable system providing heating and/or cooling through a compression cycle of a working fluid.

Compressor 502 is a compressor according to any embodiment described herein. Compressor 502 can be a multi-stage centrifugal compressor including a capacity control system, for example the compressor 100 shown in FIG. 1 and described above. Compressor 502 can be configured to receive a side stream flow as at least part of a capacity control feature thereof. The compressor 502 can include a capacity control system such as the capacity control system 200 described above and shown in FIGS. 2A, 2B, and 3.

Condenser 504 receives working fluid compressed by compressor 502. Condenser 504 is a heat exchanger configured to allow the received working fluid from compressor 502 to reject heat, so as to condense said working fluid. The rejection of heat can be to, for example, an ambient environment, a heating process fluid, a heating load, or any other suitable sink for the heat being rejected by the working fluid at condenser 504.

Expander 506 is configured to receive working fluid from condenser 504 and to expand the received working fluid. Expander 506 can be any suitable expander, such as one or more expansion valve(s), expansion orifice(s), expansion orifice plate(s), combinations thereof, and the like. In an embodiment, the expander 506 can be a controllable expander such as an electronic expansion valve.

Evaporator 508 is configured to receive the working fluid from expander 506 and exchanging heat such that the working fluid accepts heat, for example from a process fluid or a conditioned space to be cooled, from and ambient environment, or the like, so as to evaporate the working fluid. Non-limiting examples of evaporator 508 can include an evaporator of a chiller configured to cool a process fluid, coils for cooling air to be distributed to a conditioned space, or the like. Working fluid leaving the evaporator 508 can be returned to a suction of the compressor 502, and the working fluid can continue to be circulated in HVACR system 500.

FIGS. 6A-6D show compressor 600 according to an embodiment. Compressor 600 includes a first stage impeller 604. The first stage impeller 604 is driven by shaft 606. Shaft 606 is rotated by, for example, a prime mover such as a motor, an electric motor, or the like. The first stage impeller 604 is configured to draw in the working fluid that passes the one or more inlet guide vanes 602 when rotated, and to expel the working fluid towards diffuser 608.

Diffuser 608 receives the fluid discharged from first stage impeller 604 and directs the flow of the fluid towards return bend 610. Return bend 610 changes the direction of the flow of the fluid such that it travels through the deswirl vanes 612 towards a second stage impeller 618.

One or more deswirl vanes 612 are vanes extending from the return bend 610 towards the second stage impeller 618. The deswirl vanes 612 are shaped to straighten the flow of the fluid as the flow passes towards the second stage impeller 618. The deswirl vanes 612 can include notches configured to receive at least a portion of the capacity control valve 616.

Side stream injection port 614 is a port configured to allow a side stream to be introduced into the interstage flow of fluid through compressor 600. The side stream injection port 614 includes a leading end 624 and a trailing end 626, with the leading end 624 towards the return bend 610 and the trailing end 626 towards the second stage impeller 618. Side stream injection port 614 fluidly connects a side stream flow channel 628 with the interstage flow. The side stream flow channel 628 can receive a side stream of fluid from within a fluid circuit, such as for example including the compressor 600. The source of the side stream of fluid received by side stream flow channel 628 can be from one or more of a condenser, an economizer, an intercooler, a heat exchanger, or any other suitable source of fluid that is at an intermediate pressure, between the suction pressure and the discharge pressure of the compressor 600. The side stream injection port 614 can be a ring shape surrounding an intake of the second stage impeller 618. The side stream injection port 614 can be provided between the return bend 610 and the second stage impeller 618.

Capacity control valve 616 is a valve that is configured to regulate the flow through the side stream injection port 614. Capacity control valve 616 is configured to be extended axially through the side stream injection port 614, for example such that it extends substantially perpendicular to a direction of flow of the interstage flow from deswirl vane 612 towards the second stage impeller 618. Capacity control valve 616 is configured to be able to obstruct flow through side stream injection port 614 in a closed position, for example by including a portion having a thickness corresponding to the width of the side stream injection port 614 from leading end 624 to trailing end 626. In an embodiment, capacity control valve 616 is controlled in conjunction with inlet guide vanes 602. In an embodiment, capacity control valve 616 is controlled independently of inlet guide vanes 602.

Capacity control valve 616 includes a leading side 630 facing towards the return bend 610 and a trailing side 632 facing towards an inlet into second stage impeller 618. Leading side 630 includes curved surface 634 extending towards a tip 636 of the capacity control valve 116. The curved surface 634 can cause the distance between capacity control valve 616 and leading end 624 of side stream injection port 614 to be varied as capacity control valve 616 is axially extended or retracted.

Trailing side 632 includes one or more passages 638 configured to allow the side stream flow from side stream flow channel 628 to pass through the side stream injection port 614 and be introduced into the interstage flow on the trailing side 632 of the capacity control valve 616. In an embodiment, passage 638 includes one or more channels having openings on the trailing side 632 of the capacity control valve 616. In an embodiment, passage 638 is a cutout, scallop, or the like formed in the trailing side 632, such that in some positions of capacity control valve 616, a gap exists between the trailing side 632 and the trailing end 624 of the side stream injection port 614.

In the fully open position of the capacity control valve 616, side stream flow passes from the side stream flow channel 628 through side stream injection port 614, between the leading end 624 of the side stream injection port 614 and the leading side 630 of the capacity control valve 616. Tip 636 of the capacity control valve 616 is located within the side stream injection port 614 or retracted into the side stream flow channel 628, and capacity control valve 616 does not substantially affect the interstage flow passing from return bend 610 to second stage impeller 618. Optionally, in the fully open position shown in FIG. 6A, inlet guide vane 602 can be in an open position where it provides little to no resistance to flow into the first stage impeller 604. The fully open position shown in FIG. 6A can be used, for example, when compressor 600 is being operated at or near full load capacity. In the embodiment shown in FIG. 2, when in the fully open position shown in FIG. 6A, some or all of the side stream flow passing through side stream injection port 614 can pass over the leading side 630 of capacity control valve 616.

Second stage impeller 618 is used to achieve the second stage of compression. Second stage impeller 618 draws in the combined interstage and side stream flows and expels the fluid towards volute scroll 620. Second stage impeller 618 can be rotated by shaft 606, which is also used to rotate first stage impeller 604. Fluid at the volute scroll 620 can then be discharged from compressor 600 at discharge conic 622.

In an embodiment, the side stream provided through side stream injection port 614 can be received from an economizer. The economizer can be a flash-tank economizer, where flash or bypass gas rises and can be directed to the side stream flow channel 628. The gas from the economizer being directed to the side stream flow channel 628 can reduce or eliminate the presence of gas in the liquid being passed to an evaporator of the HVACR system including compressor 600. This can in turn improve the absorption of energy at the evaporator without further subcooling by providing more saturated liquid working fluid. In the full load cycle corresponding to the fully open position of capacity control valve 616, the pressure at the side stream injection port 614 can allow the entrained vapor to be substantially removed from the working fluid in the economizer.

Figure 6A:
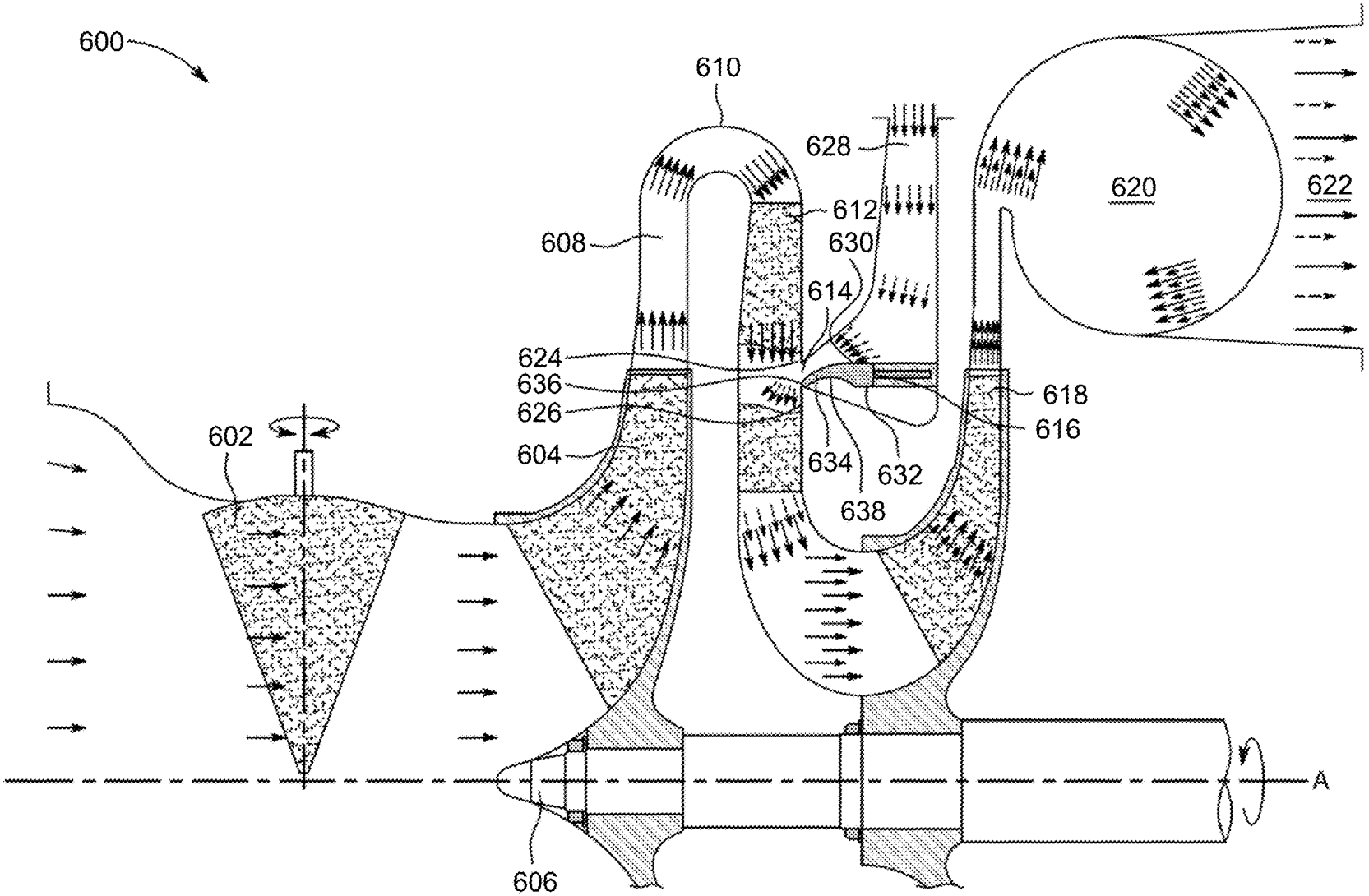
Figure 6B:
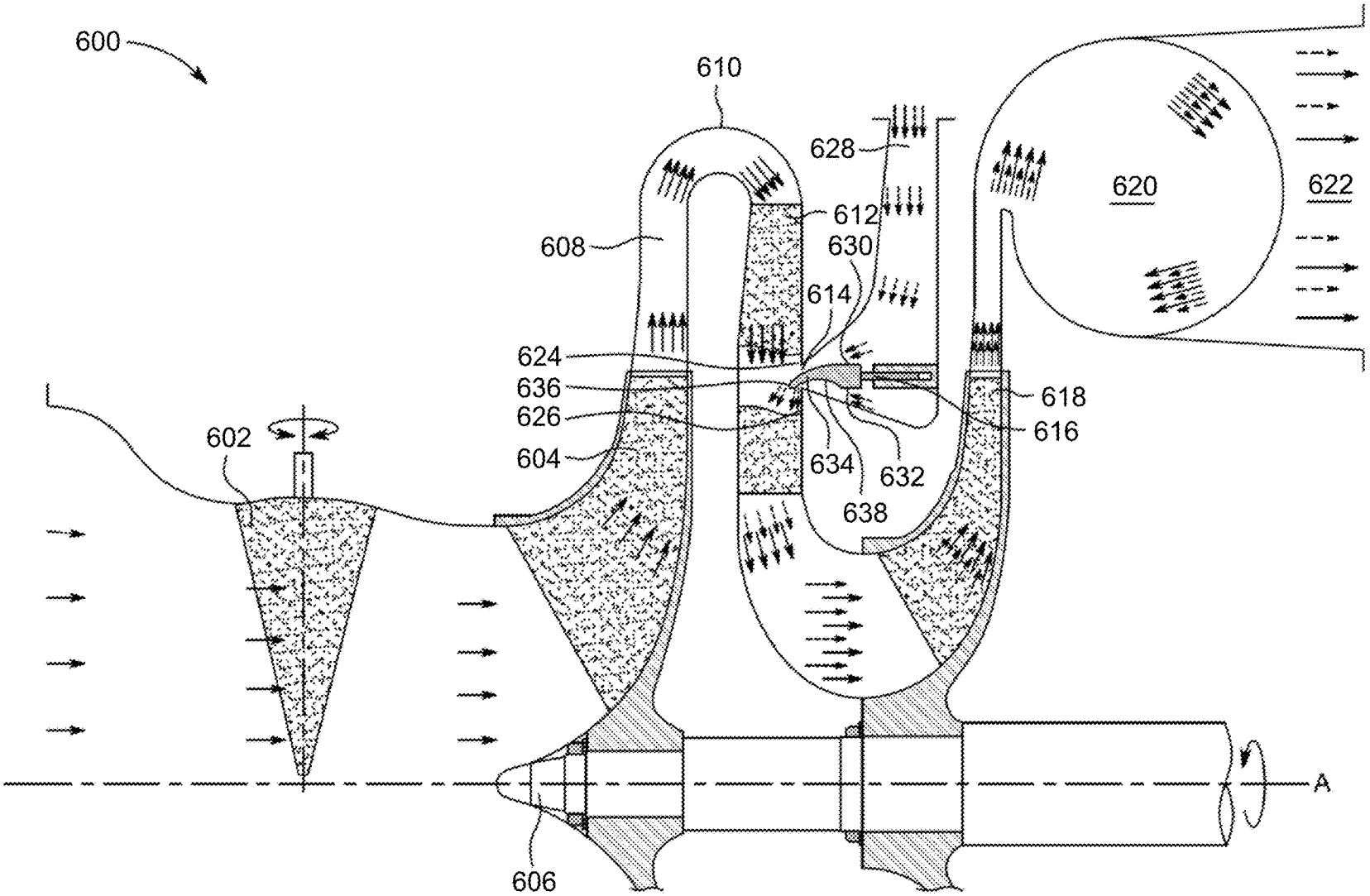

FIG. 6B shows a sectional view of the compressor shown in FIG. 6A when the capacity control valve 616 is in a high flow position. The high flow position shown in FIG. 6B can be used in a partial load condition where the load is relatively close to full load for the compressor 600. In the high flow position shown in FIG. 6B, capacity control valve 616 is extended such that tip 636 projects into the path for interstage flow from return bend 610 to the second impeller 618, partially obstructing the path for the interstage flow. In the high flow position of the embodiment shown in FIG. 6B, a first gap exists between the leading end 624 of the side stream injection port and the leading side 630 of the capacity control valve 616, and a second gap exists at passage 638 between the trailing side 632 of the capacity control valve 616 and the trailing end 626 of the side stream injection port 614. Each of the first and second gaps allow some of the side stream flow to join the interstage flow. The portion passing through the second gap experiences less of the pressure exerted by the interstage flow due to its introduction on the trailing side 632 of the capacity control valve 616. Optionally, in the high flow position shown in FIG. 6B, inlet guide vane 602 can be in a high flow position where the inlet guide vane 602 provides increased resistance to flow into the first stage impeller 604 compared to the fully open position shown in FIG. 6A, but less resistance to flow than the low flow or closed positions shown in FIGS. 6C and 6D, respectively. In the high-flow position shown in FIG. 6B, flow through side stream injection port 614 can include both flow over the leading side 630 and past the trailing side 632 of the capacity control valve.

Figure 6C:
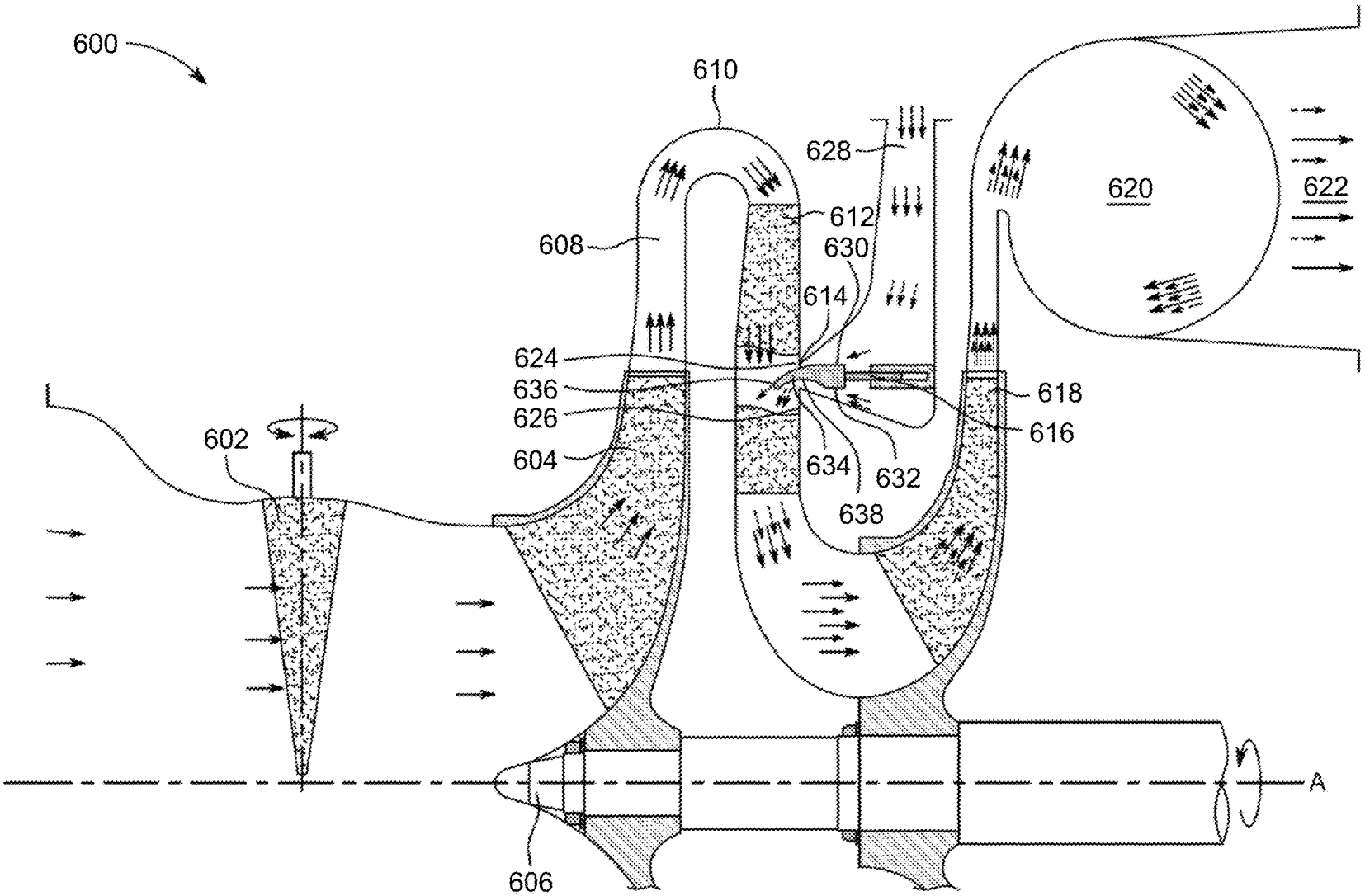

FIG. 6C shows a sectional view of the compressor shown in FIG. 6A when the capacity control valve 616 is in a low flow position. The low flow position shown in FIG. 6C can be used in a partial load condition where the load is below the full load for the compressor 600, and less than the load where the capacity control valve is in a high flow position such as in FIG. 6B. In the low flow position shown in FIG. 6C, capacity control valve 616 is extended further into the interstage flow from return bend 610 to second impeller 618. The capacity control valve 616 thus provides even greater resistance to the interstage flow when compared to the high flow position shown in FIG. 6B. In the low flow position of the embodiment shown in FIG. 6C, a first gap exists between the leading end 624 of the side stream injection port and the leading side 630 of the capacity control valve 616, and a second gap exists at passage 638 between the trailing side 632 of the capacity control valve 616 and the trailing end 626 of the side stream injection port 614. Compared to the first and second gaps shown of the high flow position shown in FIG. 6B, in the low flow position of FIG. 6C, the second gap is relatively larger compared to the first gap, and a greater proportion of the side stream flow passes through the second gap to join the interstage flow relative to the amount of the side stream flow passing through the first gap. Optionally, in the low flow position shown in FIG. 6C, inlet guide vane 602 can be in a low flow position where the inlet guide vane 602 provides increased resistance to flow into the first stage impeller 604 compared to the high flow position shown in FIG. 6B, but less resistance to flow than the closed positions shown in FIG. 6D. In the low-flow position shown in FIG. 6C, flow through side stream injection port 614 can primarily or entirely be past the trailing side 632 of the capacity control valve. The shape of the leading side 630 and of passage 638 can each or both be selected to control the relative amount of flow being introduced on either the leading side 630 or trailing side 632 of the capacity control valve 616, and how those relative amounts vary with the position of capacity control valve 616 from the fully open position through the closed position as shown in FIGS. 6A-6D.

In an embodiment, side stream flow channel 628 can receive the side stream flow from an economizer. Providing passage 638 in capacity control valve 616 can allow capacity control valve 616 to not only control the quantity of flow being introduced, but the particular point at which the side stream is introduced in side stream injection port 614, and the pressure at the point of introduction. Controlling the position of the point of introduction of side stream flow can provide control over the relationship between core flow and side stream flow in the compressor. Control of the point of introduction can improve economizer effectiveness across different load conditions. The low flow position shown in FIG. 6C can be used when compressor 600 is operated at part load. When the compressor 600 is operated at part load, the static pressure at the side stream injection port 614, particularly between leading end 624 of the side stream injection port 614 and the leading side 630 of the capacity control valve 616, can be relatively elevated. The pressure within the economizer is a function of the static pressure at the injection location in compressor 600, in addition to pipe losses and fixed orifice pressure drops for the system. The elevated pressure at side stream injection port 614 can therefore lead to an elevated pressure at the economizer, reducing effectiveness in removing flash or bypass gas from the fluid contained within. Passage 638, by being on an opposite side of the capacity control valve 616 from leading side 630 that is facing the interstage flow within compressor 600, is subject to a reduced pressure in comparison to the pressure on the leading side 630, or the static pressure at the side stream injection port 114 in the embodiment shown in FIG. 1C. The reduced pressure at such an injection point can correspondingly lower the pressure within the economizer as described above, improving the release of flash or bypass gas from liquid in the economizer and its removal from the stream of working fluid passing to the evaporator. This improves the heat transfer at the evaporator and can also reduce recompression losses in the system including compressor 600 having capacity control valve 616 including passages 638.

Figure 6D:
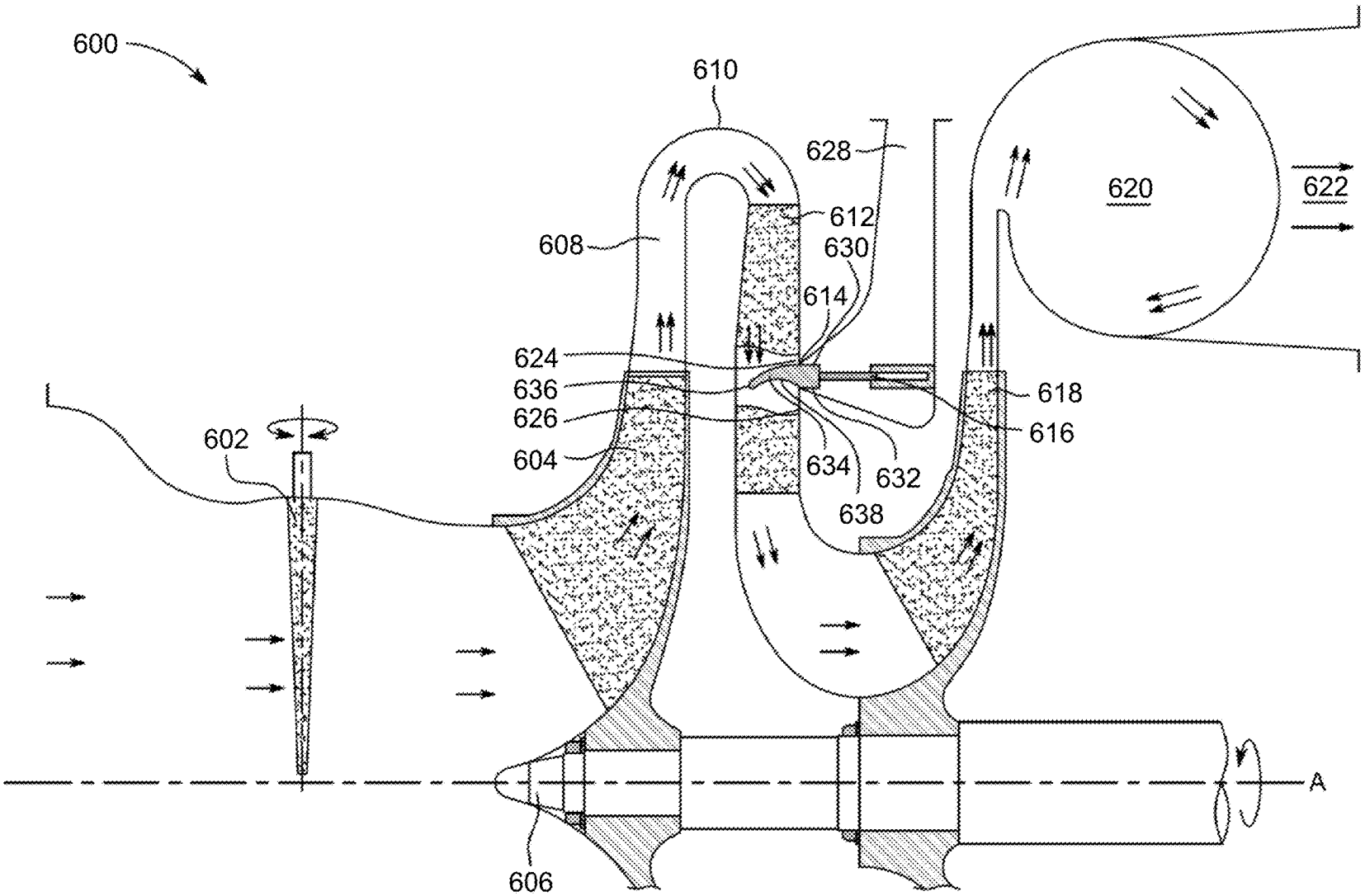

FIG. 6D shows a sectional view of the compressor shown in FIG. 6A when the capacity control valve 616 is in a closed position. The closed position shown in FIG. 6D can be used when the compressor 600 is in a partial-load condition at or near a minimum load for the compressor. In the closed position, capacity control valve 616 partially or completely obstructs side stream injection port 614, from leading end 624 to trailing end 626. It is appreciated that due to manufacturing tolerances, etc., there may be some possible leakage even when capacity control valve 616 is in the closed position. In an embodiment, capacity control valve 616 may be sized such that it does not contact side stream injection port 614, and allows some flow through the gap between the side stream injection port 614 and the capacity control valve 616. Any features of capacity control valve 616 configured to allow the introduction of the side stream flow on the trailing side 632 of the capacity control valve 616 such as passage 638 can be configured such that they do not permit such flow when capacity control valve 616 in the closed position. For example, as shown in FIG. 6D, a scalloped portion on the trailing side 632 forming passage 638 in this embodiment is sized and positioned such the trailing side 632 contacts the trailing end 626 of side stream injection port 614 when the capacity control valve 616 is extended into the closed position. The extension of the capacity control valve 616 into the interstage flow through compressor 600 is at a maximum, reducing the size of the orifice through which the interstage flow passes from return bend 610 towards second stage impeller 618. Accordingly, this position imparts the greatest additional velocity to the interstage flow, while prohibiting the side stream flow from joining the interstage flow. Optionally, inlet guide vane 602 can be rotated to further obstruct flow to the first stage impeller 604 of compressor 600, for example by pacing the inlet guide vane 602 in a minimum-flow position.

Aspects:

It is understood that any of aspects 1-5 can be combined with any of aspects 6-13 or 14-15. It is understood that any of aspects 6-13 can be combined with any of aspects 14-15.

Aspect 1. An assembly for a capacity control valve, comprising:

a drive ring;

a throttle ring;

a plurality of drive linkages, each drive linkage including a first attachment projection on the drive ring, a second attachment projection on the throttle ring, and a linkage arm joined to each of the first attachment projection and the second attachment projection, wherein the throttle ring includes:

a plurality of stabilization linkage attachment projections, separate from the second attachment projections of the plurality of drive linkages; and a plurality of stabilization linkage arms, each of the plurality of stabilization linkage arms attached to one of the stabilization linkage attachment projections.

Aspect 2. The assembly according to aspect 1, further comprising an interstage casing, wherein each of the plurality of stabilization linkage arms are attached to the interstage casing.

Aspect 3. The assembly according to any of aspects 1-2, wherein the first attachment projections of the plurality of drive linkages are evenly distributed along a circumference of the drive ring.

Aspect 4. The assembly according to any of aspects 1-3, wherein the second attachment projections of the plurality of drive linkages are evenly distributed along a circumference of the throttle ring.

Aspect 5. The assembly according to aspect 4, wherein the plurality of stabilization linkage attachment projections are evenly distributed along a circumference of the throttle ring, offset from the second attachment projections of the plurality of drive linkages.

Aspect 6. A compressor, comprising:

a first impeller;

a second impeller;

a plurality of guide vanes forming channels located between the first impeller and the second impeller, the channels configured to direct an interstage flow of the fluid from the first impeller to the second impeller;

a side stream injection port located between the first impeller and the second impeller, the side stream injection port configured to receive a side stream of a fluid; and a throttle ring configured to move in an axial direction through the side stream injection port between an extended position and a retracted position, wherein in the extended position, the throttle ring obstructs flow of the side stream of the fluid through the side stream injection port and partially obstructs the interstage flow of the fluid through the channels, and in the retracted position, the throttle ring allows the side stream of the fluid to flow through the side stream injection port; and a drive ring, wherein the throttle ring and the drive ring are connected by a plurality of drive linkages, each drive linkage including a first attachment projection on the drive ring, a second attachment projection on the throttle ring, and a linkage arm joined to each of the first attachment projection and the second attachment projection, and the throttle ring includes:

a plurality of stabilization linkage attachment projections, separate from the second attachment projections of the plurality of drive linkages; and a plurality of stabilization linkage arms, each of the plurality of stabilization linkage arms attached to one of the stabilization linkage attachment projections.

Aspect 7. The compressor according to aspect 6, further comprising an interstage casing, wherein each of the plurality of stabilization linkage arms are attached to the interstage casing.

Aspect 8. The compressor any of aspects 6-7, wherein the first attachment projections of the plurality of drive linkages are evenly distributed along a circumference of the drive ring.

Aspect 9. The compressor according to any of aspects 6-8, wherein the second attachment projections of the plurality of drive linkages are evenly distributed along a circumference the throttle ring.

Aspect 10. The compressor according to aspect 9, wherein the plurality of stabilization linkage attachment projections are evenly distributed along a circumference of the throttle ring, offset from the second attachment projections of the plurality of drive linkages.

Aspect 11. The compressor according to any of aspects 6-10, wherein the throttle ring includes teeth-like projections, and in the extended position, the teeth-like projections of the throttle ring are disposed in and obstruct the channels.

Aspect 12. The compressor according to aspect 11, wherein the teeth-like projections extend in the axial direction and include tips that curve radially inward.

Aspect 13. The compressor according to any of aspects 6-12, further comprising an actuator configured to rotate the drive ring such that the throttle ring is driven to travel in the axial direction.

Aspect 14. A method of assembling a compressor, including:

providing a drive ring;

providing a throttle ring;

attaching a plurality of first attachment projections to the drive ring;

attaching a plurality of second attachment projections to the throttle ring;

attaching each of a plurality of linkage arms to a corresponding one of the plurality of first attachment projections and to a corresponding one of the plurality of second attachment projections;

attaching a plurality of stabilization linkage attachment projections to the throttle ring, the plurality of stabilization linkage attachment projections being separate from the second attachment projections of the plurality of drive linkages; and attaching each of a plurality of stabilization linkage arms to a corresponding one of the stabilization linkage attachment projections.

Aspect 15. The method according to aspect 14, further comprising providing an interstage casing and attaching each of the plurality of stabilization linkage arms to the interstage casing.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An assembly for a capacity control valve, comprising:

a drive ring;

a throttle ring;

a plurality of drive linkages, each drive linkage including a first attachment projection on the drive ring, a second attachment projection on the throttle ring, and a linkage arm joined to each of the first attachment projection and the second attachment projection, wherein the throttle ring includes:

a plurality of stabilization linkage attachment projections, separate from the second attachment projections of the plurality of drive linkages; and a plurality of stabilization linkage arms, each of the plurality of stabilization linkage arms attached to one of the stabilization linkage attachment projections.

2. The assembly of claim 1, further comprising an interstage casing, wherein each of the plurality of stabilization linkage arms are attached to the interstage casing.

3. The assembly of claim 1, wherein the first attachment projections of the plurality of drive linkages are evenly distributed along a circumference of the drive ring.

4. The assembly of claim 1, wherein the second attachment projections of the plurality of drive linkages are evenly distributed along a circumference of the throttle ring.

5. The assembly of claim 4, wherein the plurality of stabilization linkage attachment projections are evenly distributed along a circumference of the throttle ring, offset from the second attachment projections of the plurality of drive linkages.

6. A compressor, comprising:

a first impeller;

a second impeller;

a plurality of guide vanes forming channels located between the first impeller and the second impeller, the channels configured to direct an interstage flow of a fluid from the first impeller to the second impeller;

a side stream injection port located between the first impeller and the second impeller, the side stream injection port configured to receive a side stream of the fluid; and a throttle ring configured to move in an axial direction through the side stream injection port between an extended position and a retracted position, wherein in the extended position, the throttle ring obstructs flow of the side stream of the fluid through the side stream injection port and partially obstructs the interstage flow of the fluid through the channels, and in the retracted position, the throttle ring allows the side stream of the fluid to flow through the side stream injection port; and a drive ring, wherein the throttle ring and the drive ring are connected by a plurality of drive linkages, each drive linkage including a first attachment projection on the drive ring, a second attachment projection on the throttle ring, and a linkage arm joined to each of the first attachment projection and the second attachment projection, and the throttle ring includes:

a plurality of stabilization linkage attachment projections, separate from the second attachment projections of the plurality of drive linkages; and a plurality of stabilization linkage arms, each of the plurality of stabilization linkage arms attached to one of the stabilization linkage attachment projections.

7. The compressor of claim 6, further comprising an interstage casing, wherein each of the plurality of stabilization linkage arms are attached to the interstage casing.

8. The compressor of claim 6, wherein the first attachment projections of the plurality of drive linkages are evenly distributed along a circumference of the drive ring.

9. The compressor of claim 6, wherein the second attachment projections of the plurality of drive linkages are evenly distributed along a circumference of the throttle ring.

10. The compressor of claim 9, wherein the plurality of stabilization linkage attachment projections are evenly distributed along a circumference of the throttle ring, offset from the second attachment projections of the plurality of drive linkages.

11. The compressor of claim 6, wherein the throttle ring includes teeth-like projections, and in the extended position, the teeth-like projections of the throttle ring are disposed in and obstruct the channels.

12. The compressor of claim 11, wherein the teeth-like projections extend in the axial direction and include tips that curve radially inward.

13. The compressor of claim 6, further comprising an actuator configured to rotate the drive ring such that the throttle ring is driven to travel in the axial direction.

14. A method of assembling a compressor, including:

providing a drive ring;

providing a throttle ring;

attaching a plurality of first attachment projections to the drive ring;

attaching a plurality of second attachment projections to the throttle ring;

attaching each of a plurality of linkage arms to a corresponding one of the plurality of first attachment projections and to a corresponding one of the plurality of second attachment projections;

attaching a plurality of stabilization linkage attachment projections to the throttle ring, the plurality of stabilization linkage attachment projections being separate from the second attachment projections of the plurality of drive linkages; and attaching each of a plurality of stabilization linkage arms to a corresponding one of the stabilization linkage attachment projections.

15. The method of claim 14, further comprising providing an interstage casing and attaching each of the plurality of stabilization linkage arms to the interstage casing.

* * * * *